US010344625B2

(12) United States Patent
Oden et al.

(10) Patent No.: US 10,344,625 B2
(45) Date of Patent: Jul. 9, 2019

(54) JACKING ASSEMBLY FOR ROTOR

(71) Applicant: General Electric Company, Schenectady, NY (US)

(72) Inventors: Joshua Michael Oden, Greenville, SC (US); Michael Helton, Greenville, SC (US); Jason Dixson, Gridley, CA (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 0 days.

(21) Appl. No.: 15/976,368

(22) Filed: May 10, 2018

(65) Prior Publication Data

US 2018/0258797 A1 Sep. 13, 2018

Related U.S. Application Data

(62) Division of application No. 14/700,878, filed on Apr. 30, 2015, now Pat. No. 9,970,325.

(51) Int. Cl.

| | |
|---|---|
| ***B66C 1/10*** | (2006.01) |
| ***B66C 1/62*** | (2006.01) |
| ***B66F 3/24*** | (2006.01) |
| ***B66F 9/18*** | (2006.01) |
| ***F01D 25/28*** | (2006.01) |

(52) U.S. Cl.

CPC ..... *F01D 25/285* (2013.01); *B66C 1/107* (2013.01); *B66C 1/62* (2013.01); *B66F 3/24* (2013.01); *B66F 9/18* (2013.01)

(58) Field of Classification Search

CPC .... B66F 3/00; B66F 3/36; B66F 3/247; B66F 3/46; B66F 7/26; B66F 7/10; B66F 7/16; B66F 7/246; B66F 7/025; B66F 7/14; B66F 7/12; B66F 9/04; B66F 9/187; B66F 9/186; B60B 29/001; B60B 29/002

See application file for complete search history.

(56) References Cited

U.S. PATENT DOCUMENTS

| | | | |
|---|---|---|---|
| 2,011,408 | A | 8/1935 | Jacobs |
| 2,963,270 | A | 12/1960 | Magarin |
| 3,362,160 | A | 1/1968 | Bourgeois |
| 3,527,443 | A | 9/1970 | Korkut |
| 3,769,190 | A | 10/1973 | Deem |
| 3,922,907 | A | 12/1975 | Hurwitz et al. |
| 4,330,105 | A | 5/1982 | Gallagher |
| 4,353,215 | A | 10/1982 | Anderson et al. |
| 4,451,979 | A | 6/1984 | Schuster |

(Continued)

FOREIGN PATENT DOCUMENTS

| | | |
|---|---|---|
| EP | 0 865 582 A1 | 9/1998 |
| EP | 0 907 077 A2 | 4/1999 |

(Continued)

*Primary Examiner* — Tyrone V Hall, Jr.

(74) *Attorney, Agent, or Firm* — Nixon & Vanderhye P.C.

(57) ABSTRACT

A jacking assembly for a rotor of a turbine includes an arc-shaped saddle which extends around and supports a lower portion of a rotor. A lifting beam extends over the rotor transversely to an axial direction of the rotor. The lifting beam is axially aligned with the arc-shaped saddle. Two connectors are disposed on respective lateral sides of the rotor, each connector extending between and being coupled to the lifting beam and the arc-shaped saddle such that the saddle is configured to lift the rotor vertically when the lifting beam is displaced vertically.

20 Claims, 9 Drawing Sheets

(56) References Cited

U.S. PATENT DOCUMENTS

| | | | |
|---|---|---|---|
| 4,461,455 | A | 7/1984 | Mills |
| 4,532,689 | A | 8/1985 | Harder et al. |
| 4,741,203 | A | 5/1988 | Willaman et al. |
| 5,102,074 | A | 4/1992 | Okada |
| 5,110,090 | A | 5/1992 | McDuffie |
| 5,573,210 | A | 11/1996 | Hendrix |
| 6,126,549 | A | 10/2000 | Appell et al. |
| 6,188,218 | B1 | 2/2001 | Goldfine et al. |
| 6,631,541 | B2 | 10/2003 | Mosing et al. |
| 6,657,429 | B1 | 12/2003 | Goldfine et al. |
| 6,952,095 | B1 | 10/2005 | Goldfine et al. |
| RE39,206 | E | 7/2006 | Goldfine et al. |
| 7,121,098 | B2 | 10/2006 | Hatcher |
| 7,149,632 | B1 | 12/2006 | Gao et al. |
| 7,161,350 | B2 | 1/2007 | Goldfine et al. |
| 7,230,421 | B2 | 6/2007 | Goldfine et al. |
| 7,236,564 | B2 | 6/2007 | Hopkins et al. |
| 7,348,771 | B2 | 3/2008 | Goldfine et al. |
| 7,489,811 | B2 | 2/2009 | Brummel et al. |
| 7,589,526 | B2 | 9/2009 | Goldfine et al. |
| 7,619,728 | B2 | 11/2009 | Ogburn et al. |
| 7,734,435 | B2 | 6/2010 | Thomas et al. |
| 7,871,064 | B2 | 1/2011 | Dailey |
| 7,900,562 | B2 | 3/2011 | Esposti et al. |
| 7,946,157 | B2 | 5/2011 | Habets |
| 7,994,781 | B2 | 8/2011 | Goldfine et al. |
| 8,095,328 | B2 | 1/2012 | Thomas et al. |
| 8,171,809 | B2 | 5/2012 | Fritz |
| 8,261,599 | B2 | 9/2012 | Jeffrey et al. |
| 8,270,667 | B2 | 9/2012 | Fritz et al. |
| 8,322,202 | B2 | 12/2012 | Ehehalt et al. |
| 8,510,060 | B2 | 8/2013 | Hardwicke et al. |
| 8,640,531 | B2 | 2/2014 | Remillard et al. |
| 8,713,999 | B2 | 5/2014 | Hatcher |
| 8,744,864 | B2 | 6/2014 | Bacon et al. |
| 8,745,888 | B2 | 6/2014 | Silliman et al. |
| 8,826,520 | B1 | 9/2014 | Spanos |
| 8,867,787 | B2 | 10/2014 | Singamsetti et al. |
| 8,896,661 | B2 | 11/2014 | Baleine et al. |
| 8,922,640 | B2 | 12/2014 | Hatcher et al. |
| 9,199,830 | B2 | 12/2015 | O'Brien |
| 9,421,898 | B2 | 8/2016 | Huet |
| 2003/0128736 | A1 | 7/2003 | Dalio et al. |
| 2003/0156904 | A1 | 8/2003 | Kline |
| 2004/0055138 | A1 | 3/2004 | Tomko et al. |
| 2004/0066188 | A1 | 4/2004 | Goldfine et al. |
| 2004/0216468 | A1 | 11/2004 | Hatcher |
| 2004/0267720 | A1 | 12/2004 | Liu et al. |
| 2005/0027586 | A1 | 2/2005 | Bacon et al. |
| 2005/0248339 | A1 | 11/2005 | Goldfine et al. |
| 2006/0067471 | A1 | 3/2006 | Hopkins et al. |
| 2006/0078193 | A1 | 4/2006 | Brummel et al. |
| 2006/0082366 | A1 | 4/2006 | Goldfine et al. |
| 2006/0271311 | A1 | 11/2006 | Gao et al. |
| 2007/0034805 | A1 | 2/2007 | Hopkins et al. |
| 2007/0120561 | A1 | 5/2007 | Goldfine et al. |
| 2007/0236214 | A1 | 10/2007 | Goldfine et al. |
| 2008/0215270 | A1 | 9/2008 | Thomas et al. |
| 2009/0027665 | A1 | 1/2009 | Ogburn et al. |
| 2009/0266160 | A1 | 10/2009 | Jeffrey et al. |
| 2009/0293596 | A1 | 12/2009 | Ehehalt et al. |
| 2009/0315540 | A1 | 12/2009 | Goldfine et al. |
| 2010/0050752 | A1 | 3/2010 | Habets |
| 2010/0103260 | A1 | 4/2010 | Williams |
| 2010/0114502 | A1 | 5/2010 | Badami et al. |
| 2010/0211343 | A1 | 8/2010 | Thomas et al. |
| 2011/0138937 | A1 | 6/2011 | Fritz |
| 2011/0296810 | A1 | 12/2011 | Hardwicke et al. |
| 2012/0024068 | A1 | 2/2012 | Silliman et al. |
| 2012/0024099 | A1 | 2/2012 | Main |
| 2012/0072152 | A1 | 3/2012 | Thomas et al. |
| 2012/0076345 | A1 | 3/2012 | Fritz et al. |
| 2012/0136630 | A1 | 5/2012 | Murphy et al. |
| 2012/0145976 | A1 | 6/2012 | Hynous |
| 2012/0260497 | A1 | 10/2012 | White et al. |
| 2012/0279323 | A1 | 11/2012 | Broda et al. |
| 2012/0312103 | A1 | 12/2012 | Hannott et al. |
| 2013/0083187 | A1 | 4/2013 | Xie et al. |
| 2013/0179388 | A1 | 7/2013 | Agarwal et al. |
| 2013/0192353 | A1 | 8/2013 | Hatcher |
| 2013/0194379 | A1 | 8/2013 | Baleine et al. |
| 2013/0194411 | A1 | 8/2013 | Baleine et al. |
| 2013/0194412 | A1 | 8/2013 | Hatcher et al. |
| 2013/0194413 | A1 | 8/2013 | Hatcher et al. |
| 2013/0202417 | A1* | 8/2013 | Spanos ..... F01D 25/285 415/126 |
| 2013/0233064 | A1 | 9/2013 | Ono et al. |
| 2013/0269426 | A1 | 10/2013 | Remillard et al. |
| 2013/0333201 | A1 | 12/2013 | Fogel et al. |
| 2013/0335530 | A1 | 12/2013 | Hatcher, Jr. et al. |
| 2013/0335549 | A1 | 12/2013 | Hatcher, Jr. et al. |
| 2013/0338938 | A1 | 12/2013 | Coultate |
| 2014/0055596 | A1 | 2/2014 | Hatcher, Jr. et al. |
| 2014/0063227 | A1 | 3/2014 | Baleine |
| 2014/0088887 | A1 | 3/2014 | Poon et al. |
| 2014/0088888 | A1 | 3/2014 | Poon et al. |
| 2014/0133697 | A1 | 5/2014 | Singamsetti et al. |
| 2014/0244328 | A1 | 8/2014 | Zhou et al. |
| 2014/0373610 | A1 | 12/2014 | Feindel et al. |
| 2016/0319665 | A1 | 11/2016 | Oden et al. |

FOREIGN PATENT DOCUMENTS

| | | | |
|---|---|---|---|
| EP | 1 027 598 | A1 | 8/2000 |
| EP | 0 865 582 | B1 | 3/2003 |
| EP | 1 027 598 | B1 | 12/2003 |
| EP | 1 457 910 | A2 | 9/2004 |
| EP | 1 650 583 | A2 | 4/2006 |
| EP | 1 408 201 | B1 | 7/2007 |
| EP | 2 100 031 | A2 | 8/2008 |
| EP | 1 996 807 | A1 | 12/2008 |
| EP | 2 023 180 | A1 | 2/2009 |
| EP | 2 486 439 | A2 | 9/2011 |
| EP | 2 392 983 | A2 | 12/2011 |
| EP | 2 533 041 | A1 | 2/2012 |
| EP | 2 100 031 | B1 | 4/2012 |
| EP | 2 484 892 | A2 | 8/2012 |
| EP | 2 710 437 | A2 | 3/2013 |
| EP | 2 710 438 | A2 | 3/2013 |
| EP | 2 583 262 | A1 | 4/2013 |
| EP | 2 653 651 | A2 | 10/2013 |
| EP | 2 742 341 | A1 | 6/2014 |
| EP | 2 810 055 | A1 | 12/2014 |
| EP | 2 810 056 | A1 | 12/2014 |
| EP | 2 810 057 | A1 | 12/2014 |
| EP | 2 810 115 | A1 | 12/2014 |
| EP | 2 810 116 | A1 | 12/2014 |
| EP | 2 810 117 | A1 | 12/2014 |
| WO | WO 1997/021044 | A1 | 6/1997 |
| WO | WO 1999/022231 | A1 | 5/1999 |
| WO | WO 2001/022076 | A1 | 3/2001 |
| WO | WO 2003/038238 | A2 | 5/2003 |
| WO | WO 2007/107395 | A1 | 9/2007 |
| WO | WO 2008/046931 | A2 | 4/2008 |
| WO | WO 2009/129617 | A1 | 10/2009 |
| WO | WO 2010/051128 | A1 | 6/2010 |
| WO | WO 2010/051278 | A1 | 6/2010 |
| WO | WO 2011/042744 | A2 | 4/2011 |
| WO | WO 2012/160371 | A2 | 11/2012 |
| WO | WO 2012/160730 | A2 | 11/2012 |
| WO | WO 2013/043574 | A1 | 3/2013 |
| WO | WO 2013/116006 | A1 | 8/2013 |
| WO | WO 2013/116078 | A1 | 8/2013 |
| WO | WO 2013/116079 | A1 | 8/2013 |
| WO | WO 2013/116080 | A1 | 8/2013 |
| WO | WO 2013/116475 | A1 | 8/2013 |
| WO | WO 2013/116490 | A1 | 8/2013 |
| WO | WO 2014/031955 | A1 | 2/2014 |
| WO | WO 2014/031957 | A1 | 2/2014 |
| WO | WO 2014/170232 | A1 | 10/2014 |

* cited by examiner

JACKING ASSEMBLY FOR ROTOR

CROSS-REFERENCE TO APPLICATION

This application is a divisional application of U.S. patent application Ser. No. 14/700,878, filed Apr. 30, 2015, now allowed, which is hereby incorporated herein by reference in its entirety.

FIELD OF THE INVENTION

This invention relates generally to a rotor jacking assembly, and more particularly to a rotor jacking assembly for jacking up a rotor while in place in a turbine.

BACKGROUND OF THE INVENTION

In turbines and electrical generators, it is necessary to periodically replace the journal bearings of the rotor and to conduct major inspections of the turbine. Known procedures utilize a crane to lift the rotor out of the turbine and to support the rotor while journal replacement or inspections are conducted.

It is labor-intensive to remove the rotor entirely from the turbine and use of a crane is an additional expensive and time-consuming task.

BRIEF SUMMARY OF THE INVENTION

One aspect of the disclosed technology relates to a rotor jacking assembly for jacking up a rotor while the rotor remains in place in the turbine.

Another aspect of the disclosed technology relates to performing a major inspection of the turbine while the rotor is jacked up but still in place in the rotor.

One exemplary but nonlimiting aspect of the disclosed technology relates to a jacking assembly for a rotor of a turbine, comprising an arc-shaped saddle configured to extend around and support a lower portion of a rotor, a lifting beam configured to extend over the rotor transversely to an axial direction of the rotor, the lifting beam being axially aligned with the arc-shaped saddle, and two connectors disposed on respective lateral sides of the rotor, each connector extending between and being coupled to the lifting beam and the arc-shaped saddle, wherein the saddle is configured to lift the rotor vertically when the lifting beam is displaced vertically.

Another exemplary but nonlimiting aspect of the disclosed technology relates to a jacking assembly for a rotor of a turbine, comprising an arc-shaped saddle configured to extend around and support a lower portion of a rotor, an arc-shaped retaining member connected to the saddle and configured to extend around an upper portion of the rotor so as to hold the saddle beneath the lower portion of the rotor, and two lifting devices disposed on respective lateral sides of the rotor, the lifting devices being configured to lift the saddle vertically.

Another exemplary but nonlimiting aspect of the disclosed technology relates to a method for replacing a journal bearing of a rotor of a turbine comprising providing an arc-shaped saddle configured to extend around and support a lower portion of a rotor, lifting the rotor by the saddle vertically to unload the weight of the rotor from the journal bearing while maintaining the rotor in the turbine, and removing at least a lower portion of the journal bearing while the rotor is lifted by the saddle.

Other aspects, features, and advantages of this technology will become apparent from the following detailed description when taken in conjunction with the accompanying drawings, which are a part of this disclosure and which illustrate, by way of example, principles of this invention.

BRIEF DESCRIPTION OF THE DRAWINGS

The accompanying drawings facilitate an understanding of the various examples of this technology. In such drawings.

DETAILED DESCRIPTION OF THE ILLUSTRATED EMBODIMENTS

Figure 1:
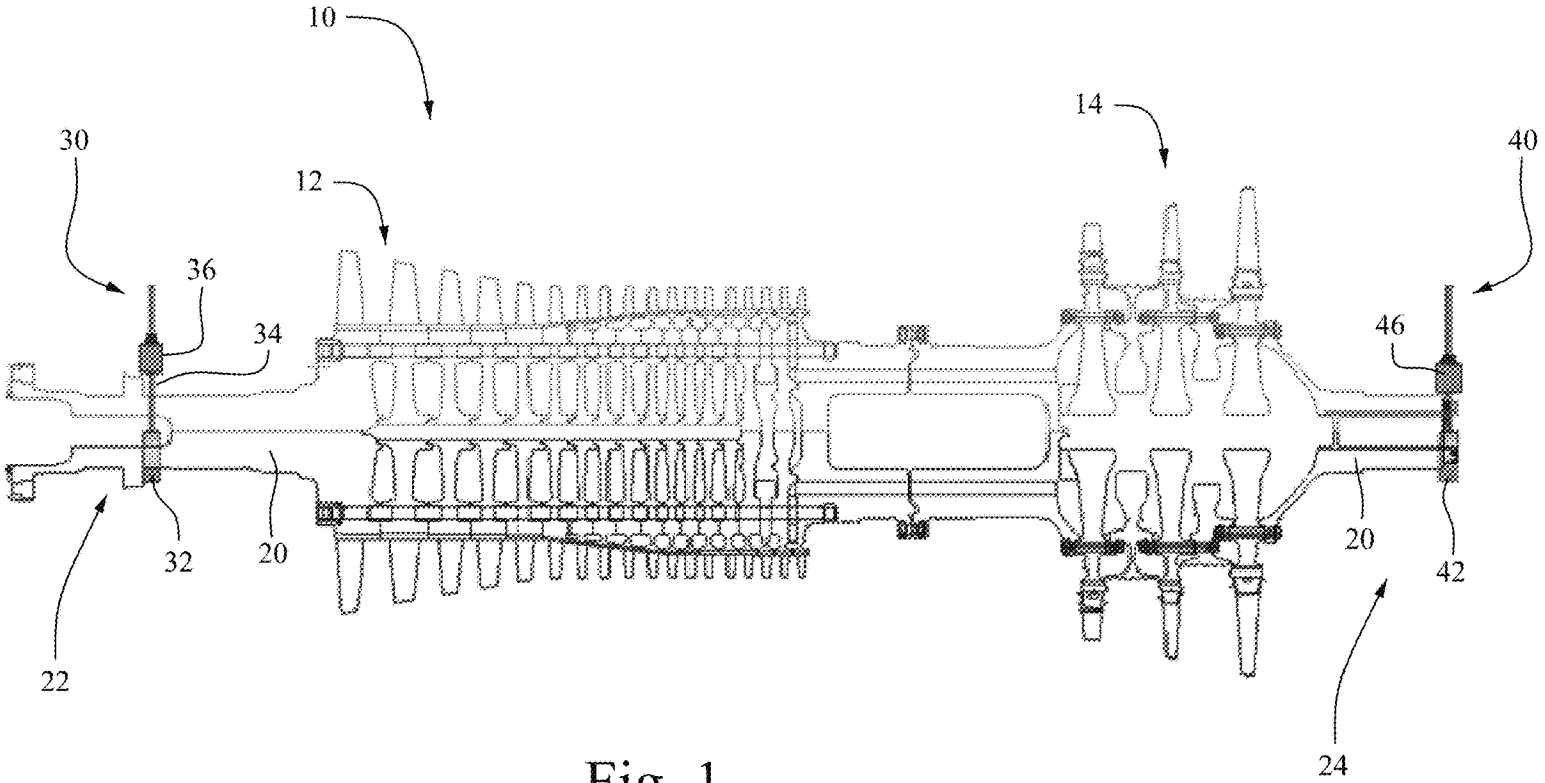
FIG. 1 is a cross-section of a gas turbine according to an example of the disclosed technology.

Referring to FIG. 1, a cross-section of a gas turbine 10 is shown. The illustrated gas turbine 10 includes a combustor section 12 and a turbine 14. As those skilled in the art will recognize, the gas turbine includes other conventional components that are not described here.

The turbine 14 is coupled to the compressor 12 via a rotor or shaft 20. Also shown in FIG. 1 is a forward end jacking assembly 30 for jacking up a forward end 22 of rotor 20. An aft end jacking assembly 40 is shown at an aft end 24 of rotor 20 for jacking up this portion of the rotor.

Figure 2:
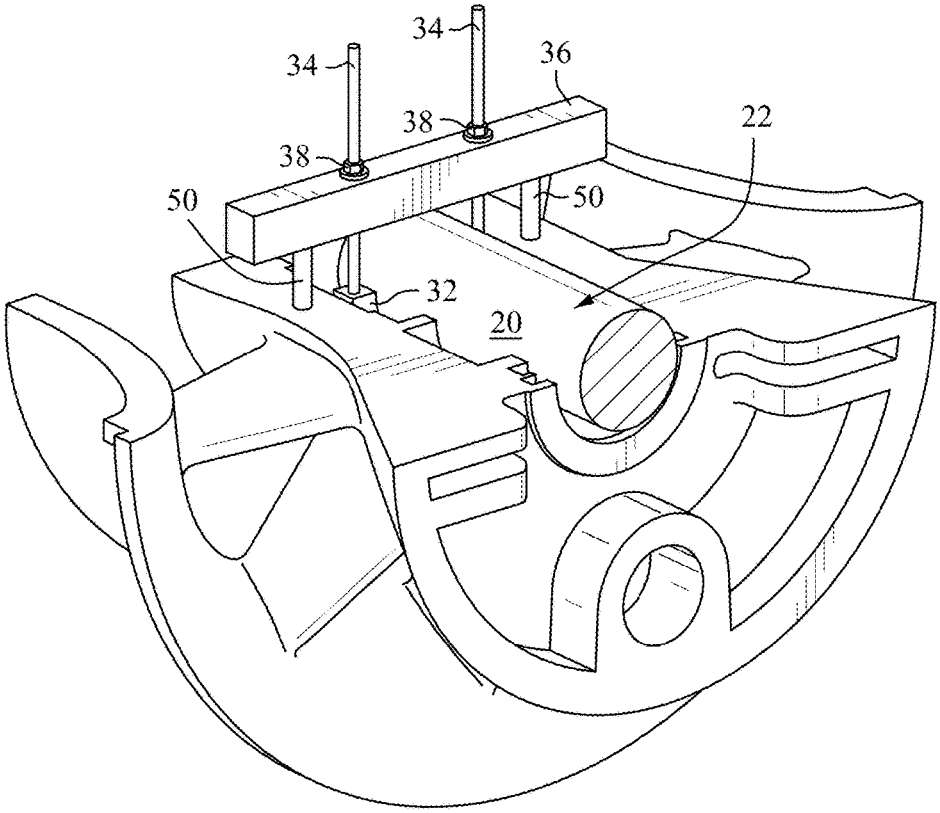
FIG. 2 is a perspective view showing a portion of a forward end of a gas turbine with a jacking assembly according to an example of the disclosed technology.
Figure 4:
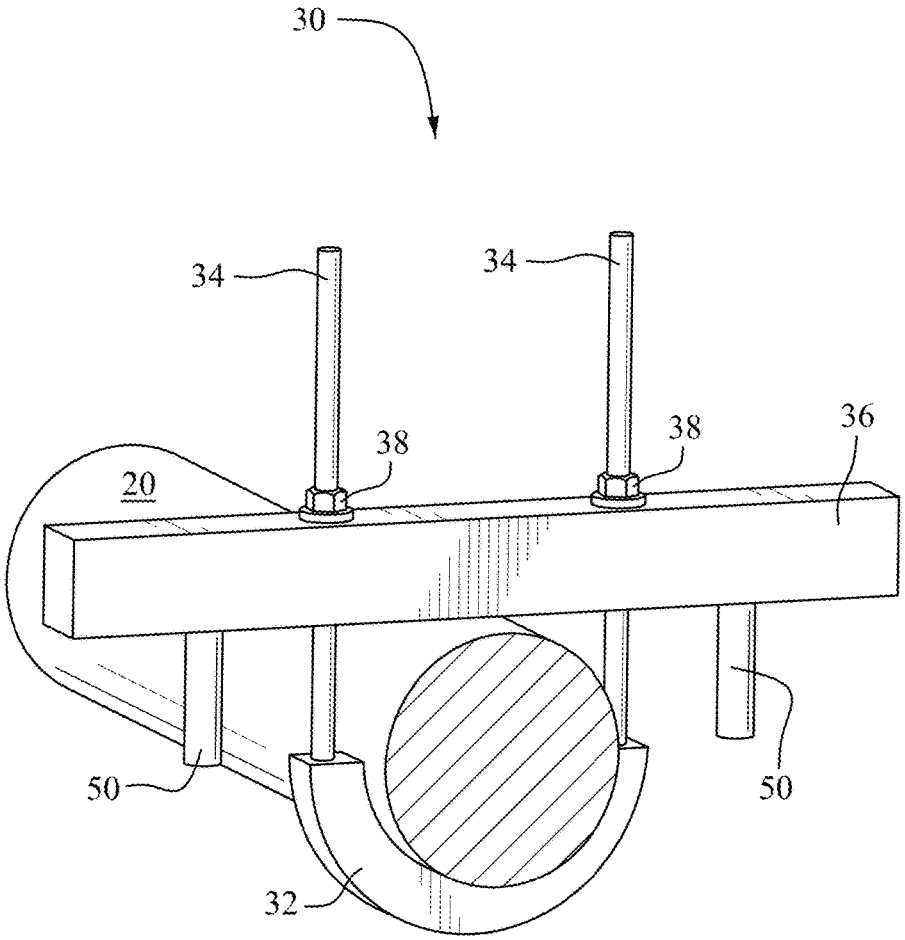
FIG. 4 is a perspective view of a jacking assembly according to an example of the disclosed technology.

As shown in FIGS. 1, 2 and 4, the jacking assembly 30 includes a saddle 32. The saddle 32 has an arc shape and is configured to extend around and support a lower portion of the rotor 20. In the illustrated example, the saddle 32 has a semicircular shape. A pair of connectors 34 are configured to be coupled to opposing ends of the saddle. In the illustrated example, the connectors 34 are threaded rods which are screwed into threaded holes in the upper end faces of the saddle.

The connectors 34 extend through respective through-holes in lifting beam 36, as shown in FIGS. 2 and 4. Locking members (e.g., nuts 38) may be positioned on connectors 34 above and beneath the lifting beam 36 to fix the location of the lifting beam relative to the connectors 34. The lifting beam 36 extends over the rotor 20 transversely to an axial direction of the rotor and is axially aligned with the saddle 32. Lifting beam 36 has an elongate rectangular shape, but those skilled in the art will recognize that the lifting beam may have other shapes (e.g., square).

A lifting device (e.g., mechanical jack 50) is positioned beneath the lifting beam 36 on each side of the rotor. The jacks 50 are configured to support a portion of the lifting beam 36. The jacks 50 are also configured to jack up lifting beam 36 which in turn causes the saddle 32 to lift the rotor. The jacks 50 use positive stop such that there is essentially no creep down over time. That is, due to their mechanical construction, the jacks can be continually loaded supporting the rotor for long periods of time (e.g., several weeks) with no creep down. The forward 22 and aft 24 ends of rotor 20 may each weight around 50,000 lbs.

Figure 3:
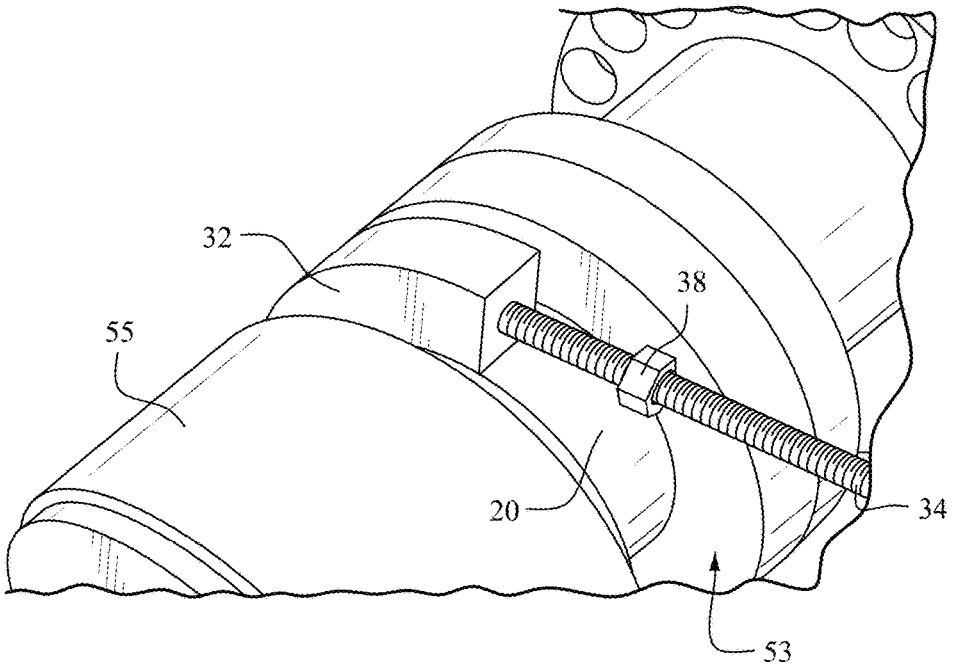
FIG. 3 is a partial perspective view of a saddle being lowed around a forward end portion of the rotor according to an example of the disclosed technology.

As can be seen in FIG. 3, the thrust bearing is removed from the thrust cage cavity 53, in order to provide room to install the saddle 32. The saddle 32 is rotated around rotor 20 until it is positioned beneath the lower portion of the rotor. The upper half 55 of the journal bearing (bearing #1) at the forward end 22 of the rotor may be removed prior to lifting the rotor.

The jacking assembly 30 is configured to lift the rotor a distance of 0.008 to 0.0225 inches (or 0.02032 to 0.5715 mm), preferably 0.01 to 0.02 inches (or 0.254 to 0.508 mm). As such, rotor 20 is not removed from the turbine. Instead, rotor 20 is raised such a small distance that the rotor remains in the turbine while lifted just enough to unload the weight of the rotor from the journal bearing.

Jacking assembly 30 is configured to hold the rotor in the lifted position while the lower half of bearing #1 is removed, inspected or replaced. While the rotor is lifted, a major inspection may be performed on the turbine. For example, steam cleaning tools and borescopes may be used to clean and inspect the lower half stator vanes while the rotor is lifted but still in place in the turbine.

Figure 6:
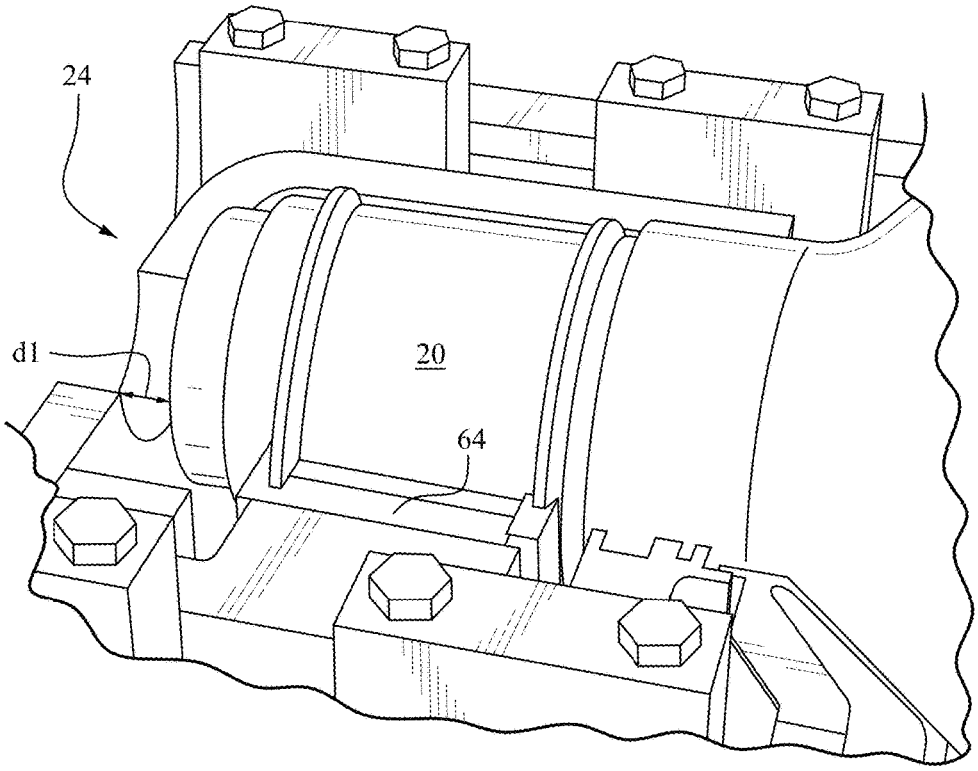
FIG. 6 is a perspective view showing a portion of an aft end of a gas turbine according to an example of the disclosed technology.

Unlike the jacking position at the forward end 22 of rotor 20, the jacking position at the aft end 24 is near an end portion of the rotor, as can be seen in FIG. 6. Additionally, a small clearance space d1 exists between the end of the rotor 20 and surrounding support structure. Also, a large space exists below the rotor 20 at the jacking position, such that a semicircular saddle may simply fall away from the rotor.

Figure 5:
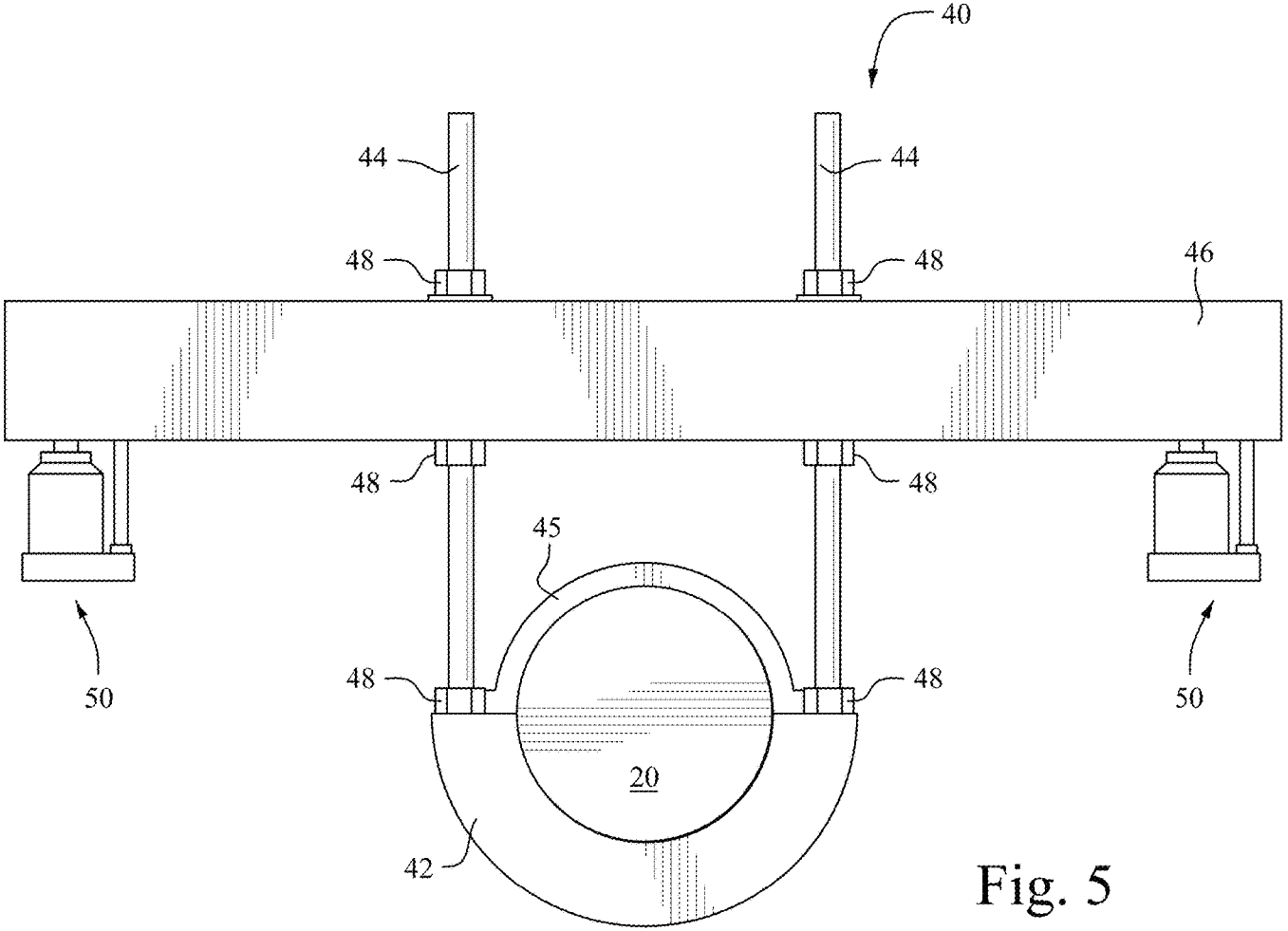
FIG. 5 is a perspective view of another jacking assembly according to an example of the disclosed technology.
Figure 7:
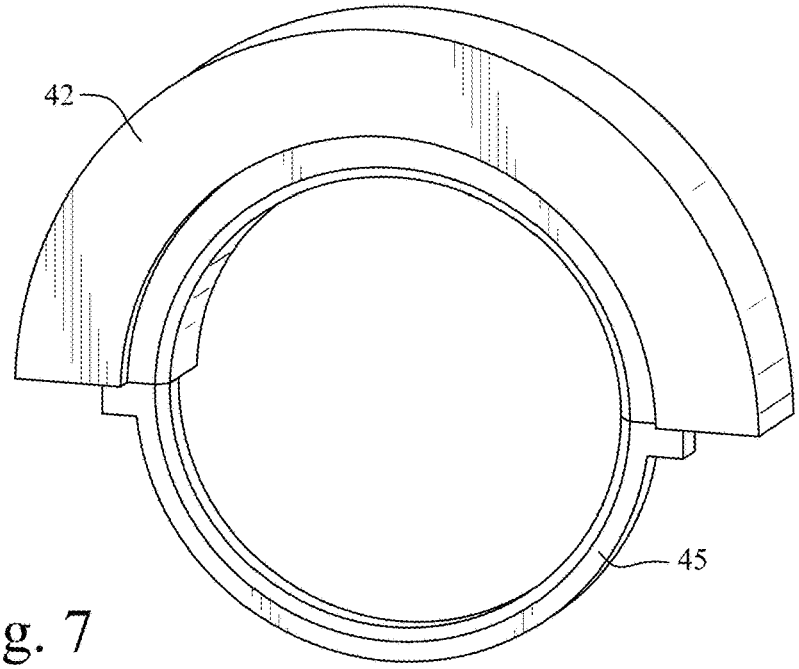
FIG. 7 is a perspective view of a saddle according to an example of the disclosed technology.
Figure 8:
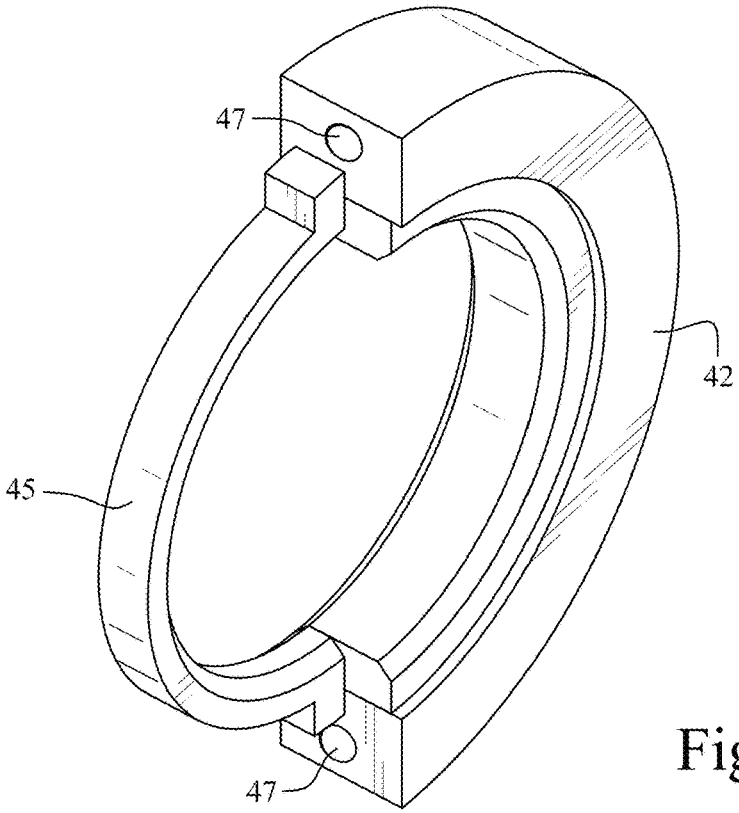
FIG. 8 is another perspective view of the saddle of FIG. 7.

As such, a saddle 42 having an arc-shaped retaining member 45 attached thereto is utilized for jacking up the aft end 24 of rotor 20, as shown in FIGS. 5, 7 and 8. Saddle 42 is similar to saddle 32. The retaining member 45 is connected to the saddle 42. In the illustrated example, the retaining member 45 has a semicircular shape and has opposing ends connected respectively to opposite ends of the saddle.

Similar to forward end jacking assembly 30, aft end jacking assembly 40 includes connectors 44 (e.g., threaded rods), a lifting beam 46, retaining members (e.g., nuts 48) and lifting devices (e.g., mechanical jacks 50), as shown in FIG. 5.

Figure 9:
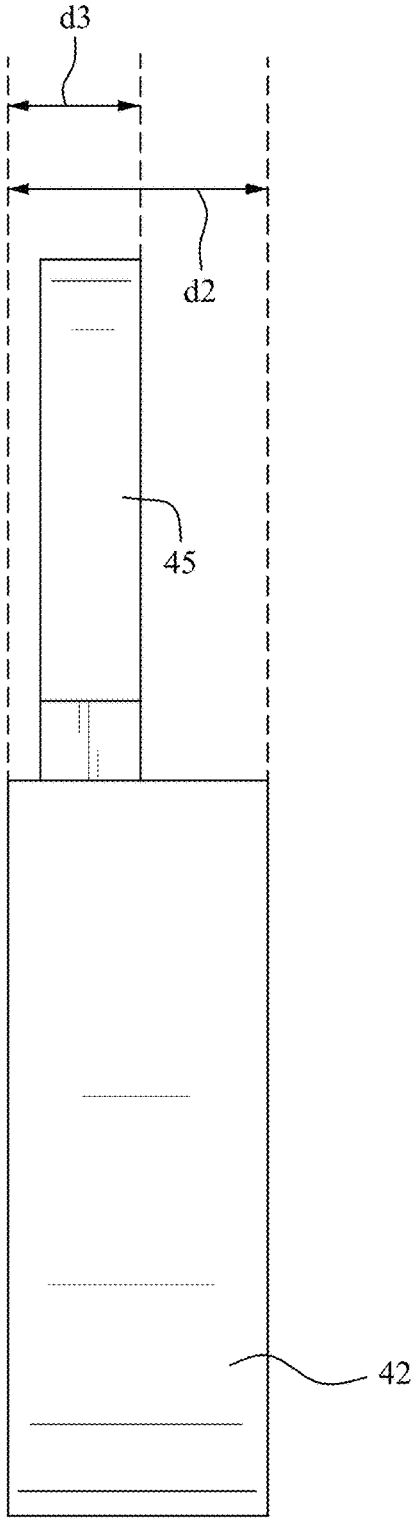
FIG. 9 is a side view of the saddle of FIG. 7.

As shown in FIG. 9, saddle 42 has a width d2. An aft edge of the retaining member 45 is positioned a distance d3 from a forward edge of the saddle. As can be seen in FIG. 9, d3 is smaller than d2. Referring to FIGS. 6 and 9, it is noted that d2 is larger than d1 while d3 is smaller than d1.

Figure 10:
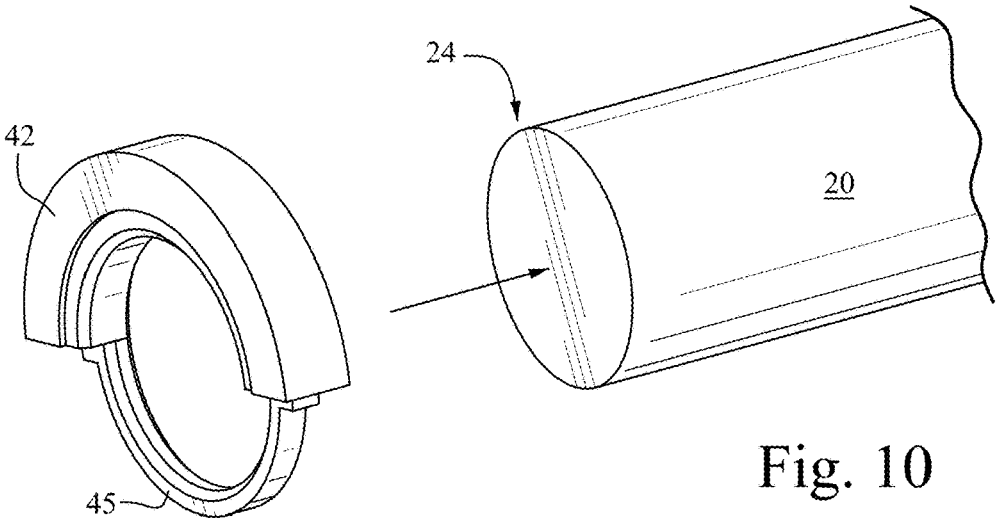
FIG. 10 is a perspective view of the saddle of FIG. 7 being installed on the aft end of the rotor according to an example of the disclosed technology.
Figure 11:
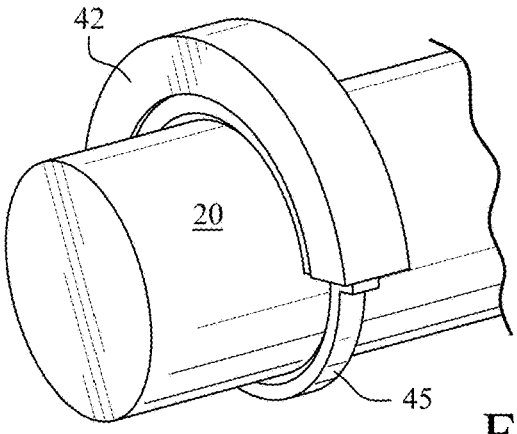
FIG. 11 is another perspective view of the saddle of FIG. 7 being installed on the aft end of the rotor according to an example of the disclosed technology.
Figure 12:
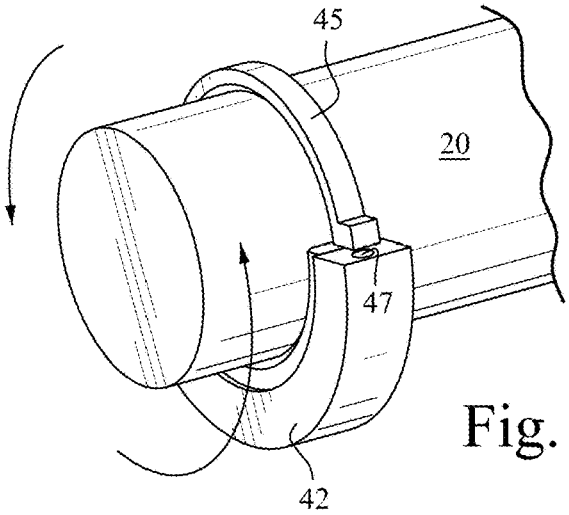
FIG. 12 is another perspective view of the saddle of FIG. 7 being installed on the aft end of the rotor according to an example of the disclosed technology.

As such, the saddle 42 is positioned on the rotor with the retaining member 45 is located downwardly so as to fit into the clearance space d1, as shown in FIGS. 10 and 11. Once positioned on the rotor, the saddle 42 and retaining member 45 are rotated to position the saddle beneath a lower portion of the rotor. The retaining member 45 is supported on an upper portion of the rotor and functions to prevent the saddle from falling away from the lower portion of the rotor. In this manner, the saddle may be positioned at the correct axial position for lifting the rotor.

Similar to the jacking assembly 30, jacking assembly 40 is configured to lift the rotor a distance of 0.008 to 0.0225 inches, preferably 0.01 to 0.02 inches. Referring to FIG. 6, while the rotor is lifted, the lower half 64 of the journal bearing (bearing #2) at the aft end of the rotor may be removed, inspected or replaced. As mentioned above, a major inspection may also be performed on the turbine.

While the invention has been described in connection with what is presently considered to be the most practical and preferred examples, it is to be understood that the invention is not to be limited to the disclosed examples, but on the contrary, is intended to cover various modifications and equivalent arrangements included within the spirit and scope of the appended claims.

What is claimed is:

1. A jacking assembly for a rotor of a turbine, comprising:
an arc-shaped saddle configured to extend around and support a lower portion of a rotor;
an arc-shaped retaining member connected to the saddle and configured to extend around an upper portion of the rotor so as to hold the saddle beneath the lower portion of the rotor; and
two lifting devices disposed on respective lateral sides of the rotor, the lifting devices being configured to lift the saddle vertically.

2. The jacking assembly of claim 1, further comprising a lifting beam configured to extend over the rotor transversely to an axial direction of the rotor, the lifting beam being axially aligned with the arc-shaped saddle, each lifting device configured to support a portion of the lifting beam to displace the lifting beam vertically.

3. The jacking assembly of claim 2, wherein each lifting device is configured to move vertically so as to displace vertically the lifting beam.

4. The jacking assembly of claim 3, wherein the two lifting devices are mechanical jacks.

5. The jacking assembly of claim 2, further comprising two connectors disposed on respective lateral sides of the rotor, each connector extending between and being coupled to the lifting beam and the arc-shaped saddle,
wherein the saddle is configured to lift the rotor vertically when the lifting beam is displaced vertically.

6. The jacking assembly of claim 5, wherein each connector has a first end directly attached to the arc-shaped saddle.

7. The jacking assembly of claim 6, wherein the two connectors are threaded rods.

8. The jacking assembly of claim 7, wherein the two connectors are coupled to the lifting beam by retaining members.

9. The jacking assembly of claim 8, wherein the retaining members are nuts received on the threaded rods.

10. The jacking assembly of claim 2, wherein the lifting beam in configured to be displaced vertically so as to lift the rotor a distance of 0.008 to 0.0225 inches.

11. The jacking assembly of claim 10, wherein the lifting beam in configured to be displaced vertically so as to lift the rotor a distance of 0.01 to 0.02 inches.

12. The jacking assembly of claim 1, wherein the arc-shaped saddle has a semicircular shape.

13. The jacking assembly of claim 12, wherein the arc-shaped retaining member has a semicircular shape.

14. The jacking assembly of claim 13, wherein opposing ends of the arc-shaped retaining member are connected respectively to opposite ends of the arc-shaped saddle.

15. A gas turbine system, comprising:

a compressor section;

a turbine; and the jacking assembly according to claim 1.

16. The gas turbine system of claim 15, further comprising a rotor, wherein the rotor is coupled to the compressor section and the turbine, and wherein the arc-shaped saddle is positioned at an aft portion of the rotor.

17. The gas turbine system of claim 16, wherein a clearance space is disposed between an aft end of the rotor and surrounding support structure, the clearance space having a width d1.

18. The gas turbine system of claim 17, wherein the arc-shaped saddle has a width d2, wherein an aft edge of the arc-shaped retaining member is positioned a distance d3 from a forward edge of the arc-shaped saddle, and wherein the width d2 of the arc-shaped saddle is larger than the width d1 of the clearance space, while the distance d3 is smaller than the width d1 such that the arc-shaped retaining member is arranged to fit in the clearance space.

19. The gas turbine system of claim 16, further comprising a lifting beam configured to extend over the rotor transversely to an axial direction of the rotor, the lifting beam being axially aligned with the arc-shaped saddle, each lifting device configured to support a portion of the lifting beam to displace the lifting beam vertically.

20. The gas turbine system of claim 19, further comprising two connectors disposed on respective lateral sides of the rotor, each connector extending between and being coupled to the lifting beam and the arc-shaped saddle, wherein the saddle is configured to lift the rotor vertically when the lifting beam is displaced vertically.

* * * * *